US011202950B2

(12) United States Patent
Russo

(10) Patent No.: US 11,202,950 B2
(45) Date of Patent: Dec. 21, 2021

(54) GOLF TRAINING AND ALIGNMENT DEVICE

(71) Applicant: Justin Russo, Wilmington, NC (US)

(72) Inventor: Justin Russo, Wilmington, NC (US)

( * ) Notice: Subject to any disclaimer, the term of this patent is extended or adjusted under 35 U.S.C. 154(b) by 0 days.

(21) Appl. No.: 16/789,876

(22) Filed: Feb. 13, 2020

(65) Prior Publication Data

US 2020/0306611 A1 Oct. 1, 2020

Related U.S. Application Data

(60) Provisional application No. 62/824,692, filed on Mar. 27, 2019.

(51) Int. Cl.
*A63B 69/36* (2006.01)

(52) U.S. Cl.
CPC ..... *A63B 69/3667* (2013.01); *A63B 2209/08* (2013.01)

(58) Field of Classification Search
CPC . A63B 69/3667; A63B 2209/08; A63B 57/00; A63B 60/62; A63B 71/146; A63B 69/3621; A63B 69/3676; A63B 69/3623; A63B 2210/50
USPC ..... 473/218, 219, 257, 261, 262, 264–268, 473/270, 409
See application file for complete search history.

(56) References Cited

U.S. PATENT DOCUMENTS

| | | | | |
|---|---|---|---|---|
| 3,384,408 | A * | 5/1968 | Furzey | H01F 7/0257 294/65.5 |
| 4,178,029 | A * | 12/1979 | LaPan | H01F 7/0257 294/65.5 |
| 4,554,703 | A * | 11/1985 | Matuki | B03C 1/284 15/424 |
| 5,551,695 | A * | 9/1996 | Wolk | A63B 67/02 473/236 |
| 7,607,988 | B1 * | 10/2009 | Laiacona | A63B 69/3623 473/257 |
| 8,435,131 | B1 * | 5/2013 | Carter | A63B 69/3676 473/265 |
| 8,726,525 | B2 * | 5/2014 | Bagley | B26B 21/52 30/279.2 |
| 9,259,635 | B2 * | 2/2016 | Downing | A63B 45/02 |
| 10,088,266 | B1 * | 10/2018 | Fournerat | F41C 23/06 |
| 10,195,510 | B2 * | 2/2019 | Simone | A63B 69/3667 |
| 2005/0116392 | A1 * | 6/2005 | Vesci | H01F 7/0221 264/611 |

(Continued)

*Primary Examiner* — Nini F Legesse
(74) *Attorney, Agent, or Firm* — Ashley D. Johnson; Dogwood Patent and Trademark Law

(57) ABSTRACT

The presently disclosed subject matter is generally directed to one or more golf alignment rods that can be used as a multipurpose golf training aid, such as to teach proper golf club alignment and/or swing technique. Particularly, the alignment rod comprises a base defined by a first end and a second end. The alignment rod further includes a cap positioned at one end of the base. The cap comprises a magnet positioned on an interior surface. The magnet allows two or more alignment rods to be removably coupled together, such as when stored upright in a golf bag. In this way, movement of the alignment rods in the golfer's bag (e.g., when the cart is in motion) is minimized. In addition, the alignment rods are more easily accessible when needed by the golfer.

20 Claims, 14 Drawing Sheets

(56) References Cited

U.S. PATENT DOCUMENTS

| | | | | |
|---|---|---|---|---|
| 2012/0230806 | A1* | 9/2012 | Rumpel | A45C 15/00<br>414/800 |
| 2012/0292936 | A1* | 11/2012 | Harris | A63B 60/16<br>294/190 |
| 2014/0113738 | A1* | 4/2014 | Shore | A63B 69/3667<br>473/266 |
| 2017/0065870 | A1* | 3/2017 | Wilcox | A63B 53/0487 |
| 2018/0274880 | A1* | 9/2018 | Tanzini | F41B 15/00 |

* cited by examiner

GOLF TRAINING AND ALIGNMENT DEVICE

CROSS-REFERENCE TO RELATED APPLICATIONS

The subject application claims priority to U.S. Provisional Patent Application No. 62/824,692, filed Mar. 27, 2019, the entire content of which is hereby incorporated by reference herein.

TECHNICAL FIELD

The presently disclosed subject matter is generally directed to a golf training and alignment aid, and more particularly to an improved device that allows a golfer to properly align their body and/or golf club when striking a golf ball.

BACKGROUND

The game of golf continues to grow in popularity worldwide. While millions of people play golf, the game is recognized as being inherently difficult. Accordingly, golfers are constantly looking for ways to improve their game. As a result, many golf training aids have been developed. For example, alignment rods are commonly used by golfers in an effort to improve golf ball alignment with a target (e.g., green or hole). Particularly, alignment rods are typically positioned on a support surface to indicate a target line and/or offer visual cues for other aspects of a golf swing. As a result, the golfer's stance is properly aligned with the target. However, prior art alignment rods suffer from several drawbacks. For example, alignment rods are commonly carried upright in the user's golf bag. However, prior art alignment rods independently move around the golf bag and frequently contact adjacent golf clubs and/or other items, making noise and potentially causing damage. In addition, due to movement around the golf bag, locating the alignment rods when needed requires extra time. Sleeves have been developed to prevent excessive movement of alignment rods. However, insertion and removal of the alignment rods into and from the sleeves is cumbersome and time consuming. Accordingly, it would be beneficial to provide alignment rods that overcome the shortcomings of the prior art.

SUMMARY

In some embodiments, the presently disclosed subject matter is directed to a golf alignment device. The golf alignment device comprises an elongated base defined by opposing first and second ends separated by a length therebetween. The golf alignment device further includes a cap comprising an interior, an open end operably connected to the interior, a closed end, and a magnet positioned within the interior. The cap is positioned on the first end of the base, such that the first end is housed within the cap interior.

In some embodiments, the second end of the base is tapered or pointed.

In some embodiments, the golf alignment device further comprises a second cap positioned on the second end of the base, such that the second end is housed within an interior of the second cap.

In some embodiments, the golf alignment device has a length of about 30-60 inches, a diameter of about 0.1-1 inches, or both.

In some embodiments, the base is constructed from fiberglass, polymeric material, wood, metal, graphite, stone, or combinations thereof.

In some embodiments, the cap is constructed from rubber, silicone, vinyl, fabric, polymeric material, leather, knit fibers, or combinations thereof.

In some embodiments, the cap is permanently attached to the first end of the base.

In some embodiments, the cap is releasably attached to the first end of the base.

In some embodiments, the magnet is a diametric magnet.

In some embodiments, the magnet is an axial magnet.

In some embodiments, the magnet is constructed from one or more of iron, cobalt, nickel, copper, platinum, aluminum, or alloys thereof.

In some embodiments, the magnet has a magnetization grade of N38-N52.

In some embodiments, the magnet has a pull force of about 4-11 pounds.

In some embodiments, the first end of the base contacts the magnet when the cap is positioned on the first end of the base.

In some embodiments, the first end of the base is positioned adjacent to the magnet when the cap is positioned on the first end of the base.

In some embodiments, the presently disclosed subject matter is directed to a method of releasably coupling two golf alignment devices together. Particularly, the method comprises positioning a first alignment device adjacent to a second alignment device, such that magnetic forces couple the magnets of the first and second alignment devices together. The first and second alignment devices can be uncoupled by separating the first and second alignment rods such that magnetic forces no longer couple the magnets of the first and second alignment devices together. The first and second alignment devices each comprise an elongated base defined by opposing first and second ends separated by a length therebetween and a cap. The cap comprises an interior, an open end operably connected to the interior, a closed end, and a magnet positioned within the interior. The cap is positioned on a first end of the base, such that the first end is housed within the cap interior.

In some embodiments, the second end of the base is tapered or pointed.

In some embodiments, the magnet is a diametric magnet or an axial magnet.

In some embodiments, the magnet has a magnetization grade of N38-N52.

In some embodiments, the magnet has a pull force of about 4-11 pounds.

DETAILED DESCRIPTION

Figure 1:
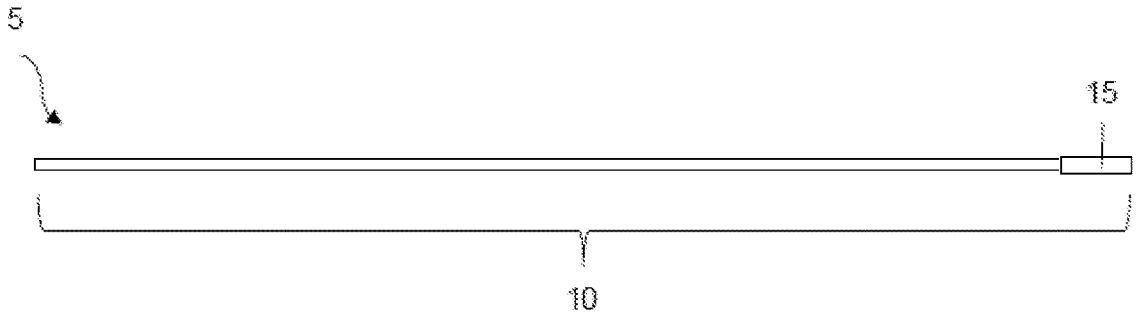
FIG. 1 is a side plan view of an alignment rod in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to one or more golf alignment rods that can be used as a multipurpose golf training aid, such as to teach proper golf club alignment and/or swing technique. Particularly, as shown in FIG. 1, alignment rod 5 comprises elongated base 10 defined by a first end and a second end. The alignment rod includes cap 15 positioned at one end of the base. As set forth in more detail herein below, the cap comprises a magnet positioned on an interior surface. The magnet allows two or more alignment rods 5 to be removably coupled together, such as when stored upright in a golf bag. In this way, movement of the alignment rods in the golfer's bag (e.g., when the cart is in motion) is minimized. In addition, the alignment rods are more easily accessible when needed by the golfer.

Figure 2A:
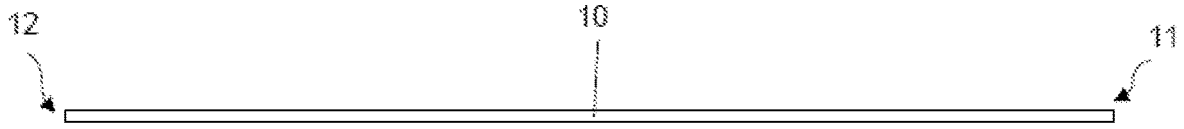
FIG. 2*a* is a side plan view of an alignment rod base in accordance with some embodiments of the presently disclosed subject matter.
Figure 2B:
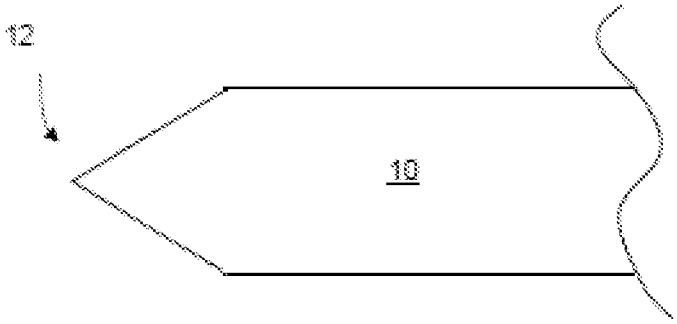
FIG. 2*b* is a fragmentary side plan view of an alignment rod base in accordance with some embodiments of the presently disclosed subject matter.
Figure 3A:
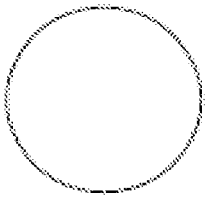
FIGS. 3*a*-3*h* are cross-sectional views of several embodiments of an alignment rod base in accordance with some embodiments of the presently disclosed subject matter.
Figure 3B:
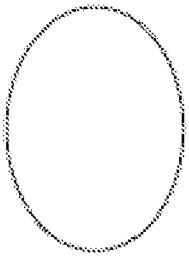
Figure 3C:
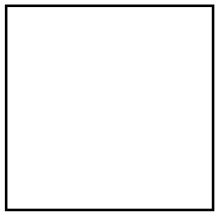
Figure 3D:
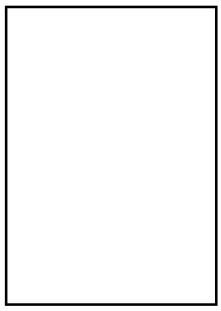
Figure 3E:
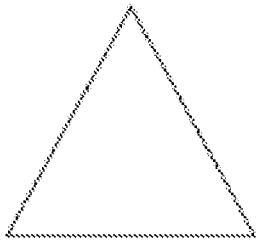
Figure 3F:
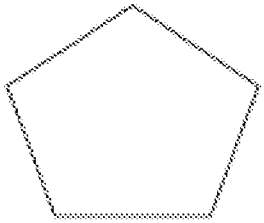
Figure 3G:
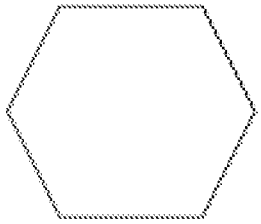
Figure 3H:
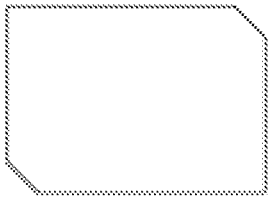

FIG. 2*a* illustrates one embodiment of elongated base 10 comprising first end 11 and second end 12. The term "elongated" refers to the characteristic of having a length substantially greater than the width. First end 11 is sized and shaped to cooperate with cap 15, as described below. Second end 12 can be blunt, as shown in FIG. 2*a*. Alternatively, the second end can be tapered or pointed, allowing it to be wedged into the ground if needed, as illustrated in FIG. 2*b*. It should be appreciated that first and second ends 11, 12 can be configured in any desired shape.

Base 10 can have any desired cross-sectional shape. The term "cross-sectional shape" refers to a section cut perpendicularly to the longitudinal axis. As shown in FIGS. 3*a*-3*f*, the base can be configured with a circular, oval, square, rectangular, triangular, pentagonal, hexagonal, or abstract cross-sectional shape. It should be appreciated that the cross-sectional shape of base 10 is not limited to those depicted in the figures, and any desired shape can be used.

Figure 4A:
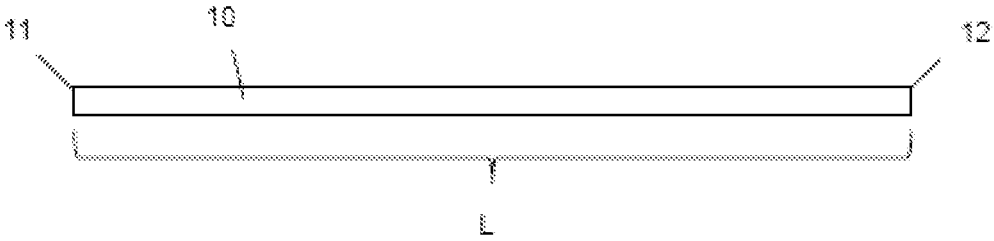
FIG. 4*a* is a side plan view of an alignment rod base in accordance with some embodiments of the presently disclosed subject matter.

Base 10 can be configured with any desired length suitable for the intended instructional purpose. The term "length" as used herein refers to the longest dimension in the longitudinal direction (e.g., from first end 11 to second end 12 as shown by "L" in FIG. 4*a*). In some embodiments, the base can have a length of about 30-60 inches, such as at least about (or no more than about) 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 inches. However, the presently disclosed subject matter is not limited, and base 10 can have a length greater or smaller than the range set forth above.

Figure 4B:
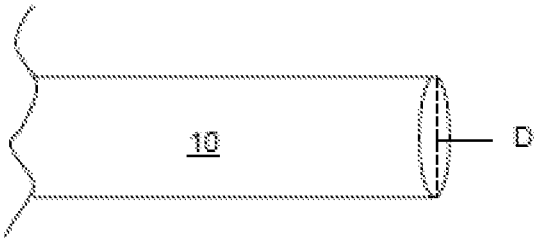
FIG. 4*b* is a fragmentary perspective view of an alignment rod base in accordance with some embodiments of the presently disclosed subject matter.

The base can have any desired diameter. The term "diameter" refers to the distance of a straight-line segment passing through the center of an object, segment, or face, as shown by "D" in FIG. 4*b*. For example, in some embodiments, the base can have a diameter of about 0.1-1 inches. Thus, the base can have a diameter of at least about (or no more than about) 0.1, 0.2, 0.3, 0.4, 0.5, 0.6, 0.7, 0.8, 0.9, or 1 inch. However, it should be appreciated that the base can have a diameter larger or smaller than the range set forth above. In some embodiments, the diameter of base 10 is consistent about the length of the base. However, the presently disclosed subject matter also includes embodiments wherein the diameter of the base tapers or varies.

Base 10 can be constructed from any desired rigid or semi-rigid material. The term "rigid material" refers to any material that does not readily bend under pressure. The term "semi-rigid material" refers to a material that can bend under the application of pressure without breaking. Suitable rigid and/or semi-rigid materials can include (but are not limited to) fiberglass, polymeric material, wood, metal (aluminum, carbon fiber, etc.), graphite, stone, or combinations thereof.

In some embodiments, the materials used to construct base 10 can be lightweight to ensure easy handling and maneuvering of the device. Thus, the base (and/or corresponding device) can have a weight of less than about 0.25-5 pounds (e.g., less than about 5, 4.5, 4, 3.5, 3, 2.5, 2, 1.5, 1, 0.5, or 0.25 pounds.

Any known method can be used to construct base 10. For example, welding, thermoforming, casting, and the like can be used. Such methods are well known in the art. In some embodiments, base 10 can be constructed to be hollow. Alternatively, the base can be solid to add weight to the device.

Figure 5A:
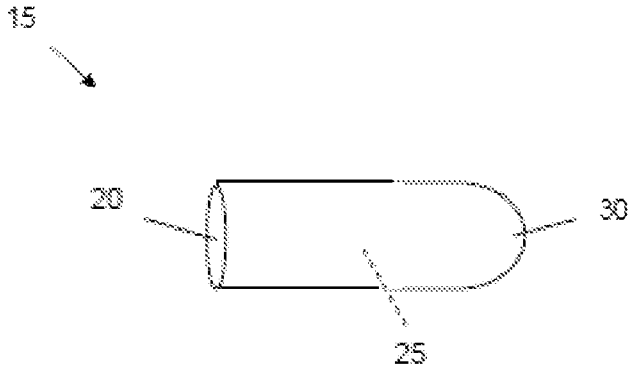
FIGS. 5*a* and 5*b* are perspective views of alignment rod caps in accordance with some embodiments of the presently disclosed subject matter.

As set forth above, at least one end of base 10 includes cap 15, as illustrated in FIG. 5*a*. As shown, the cap includes open end 20 that provides access to cap interior 25. The cap further includes closed end 30. The open end and interior are sized and shaped to fit over first end 11 of the base. In this way, one end of base 10 is housed within cap interior 25. Closed end 30 ensures that the cap does not slide down the length of the base. The term "open end" as used herein refers to an end portion of an opening that is devoid of a border or connected element. The term "closed end" refers to an end portion that includes a defined border or connected element. The closed end can be fully closed or partially closed with an opening sized and shaped such that it cannot advance down the length of the base.

Figure 5B:
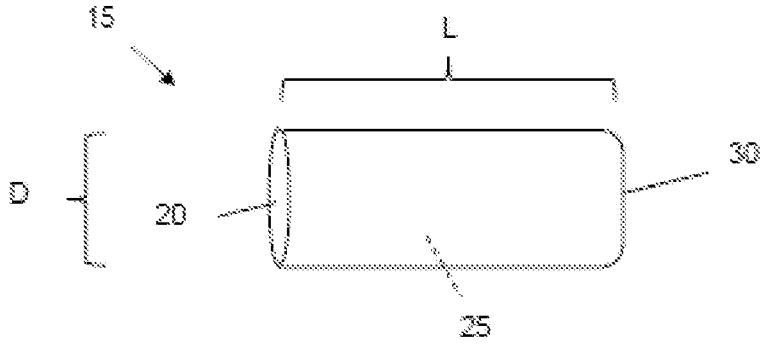

In some embodiments, closed end 30 can be rounded, as illustrated in FIG. 5*a*. Alternatively, the closed end can be vertically oriented, as shown in FIG. 5*b*. The closed end can therefore have any desired shape.

The cap can include any desired cross-sectional shape. In some embodiments, the cap has the same or about the same cross-sectional shape as base 10. However, the presently disclosed subject matter is not limited and cap 15 can have a different cross-sectional shape relative to the base.

The cap can be configured with any desired dimensions, such as with a length of about 0.5-5 inches. Thus, the cap can have a length (L) of at least about (or no more than about) 0.2-1.5 inches (e.g., at least/no more than about 0.2, 0.3, 0.4, 0.5, 0.6, 0.7, 0.8, 0.9, 1, 1.1, 1.2, 1.3, 1.4, or 1.5 inches).

Similarly, the magnet cap can have an inner diameter (D) of about 0.1-1.5 inches (e.g., at least about or no more than about 0.1, 0.2, 0.3, 0.4, 0.5, 0.6, 0.7, 0.8, 0.9, 1, 1.1, 1.2, 1.3, 1.4, or 1.5 inches). However, the presently disclosed cap can be configured with a diameter and/or length outside the ranges set forth above. It should be appreciated that the inner diameter of the cap (e.g., the diameter of cap interior 25) is configured to be larger than the outer diameter of the base to allow first end 11 to be housed within cap opening 20 and/or interior 25. In some embodiments, the diameter of opening 20 is about 0.5-10 percent larger than the outer diameter of the base (e.g., at least/no more than about 0.5, 1, 1.5, 2, 2.5, 3, 3.5, 4, 4.5, 5, 5.5, 6, 6.5, 7, 7.5, 8, 8.5, 9, 9.5 or 10 percent). However, the presently disclosed subject matter also includes embodiments larger or smaller than the stated range.

Cap 15 can be constructed from any desired material. Thus, suitable materials can be selected from (but are not limited to) rubber, silicone, vinyl, fabric, polymeric material, leather, knit fibers, or combinations thereof.

In some embodiments, cap 15 is permanently attached to first end 11 of base 10. Any known method can be used to attach the cap, such as (but not limited to) adhesive, ultrasonic seal, welding, and/or heat seal. Alternatively, the cap can be releasably attached to the base using any known mechanism, such as (but not limited to) pressure fit attachment, snap fit attachment, interference fit, screw threads, and/or the use of mechanical closures (e.g., pins, screws, and the like).

Figure 6A:
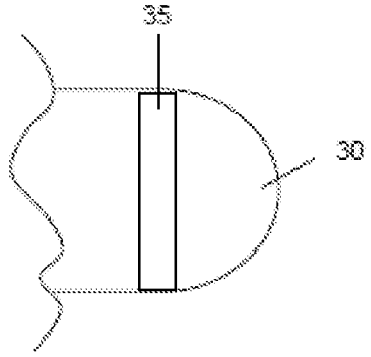
FIGS. 6*a* and 6*b* are side plan views of magnets housed within the interior of alignment rod caps in accordance with some embodiments of the presently disclosed subject matter.
Figure 6B:
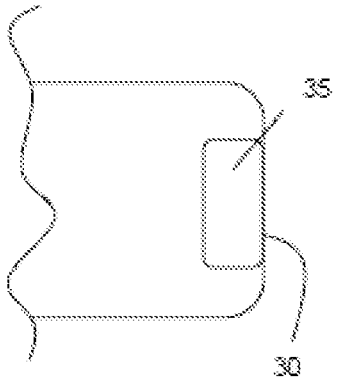
Figure 6C:
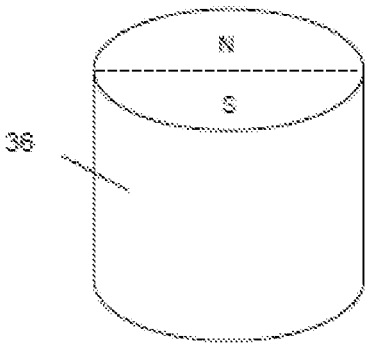
FIG. 6*c* is a perspective view of a diametric magnet in accordance with some embodiments of the presently disclosed subject matter.
Figure 6D:
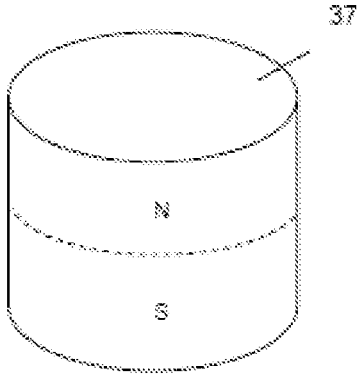
FIG. 6*d* is a perspective view of an axial magnet in accordance with some embodiments of the presently disclosed subject matter.

Cap interior 25 includes magnet 35, as shown in FIGS. 6*a* and 6*b*. Particularly, the magnet can be housed at or adjacent to the closed cap end. The term "magnet" refers to a body that produces a magnetic field externally unto itself. In some embodiments, magnet 35 is diametric (i.e., a magnet that includes a polarity plane separating a north pole half from a south pole half), as illustrated in FIG. 6*c*. Alternatively, in some embodiments, magnet 35 can be an axial magnet, having axial magnetic orientation. It should be appreciated that when axial magnets are used in an alignment rod pair, they can be oppositely oriented, to allow the north pole of one magnet to attract the south pole of a corresponding magnet. Generally, diametric magnets can provide a stronger attraction, while axial magnets can provide better longitudinal alignment. Combining these magnet types can optionally provide a mixture of these benefits. It should be appreciated that magnet 35 can be any known magnet type and is not limited to diametric and axial magnets.

Magnet 35 can be constructed from any material that can be magnetized. For example, the magnet can include (but is not limited to) iron, cobalt, nickel, copper, platinum, aluminum, and/or alloys thereof.

Magnet 35 can have any desired magnetization grade, such as (but not limited to) about N38-N52 (e.g., a pull force of about 4 pounds to about 11 pounds). The term "pull force" refers an action or stress resulting from applied forces that cause or tend to cause two objects to move relative to each other in a direction perpendicular to their plane of contact. In some embodiments, the "pull force" is the amount of force needed to pull on a magnet to move it away from a steel surface (e.g., a 2 inch thick, ground, flat steel plate). Thus, the magnet can have a pull force of about 4, 5, 6, 7, 8, 9, 10, or 11 pounds. However, magnets with greater or less pull force are also within the scope of the presently disclosed subject matter. Magnetization grades measure the strength of a particular magnet. In general, a higher number indicates a stronger magnet. The number represents the strongest point on the magnet's demagnetization curve (also called "BH curve").

The magnet can be configured in any desired size and shape, so long as it can fit within cap interior 25. Thus, the magnet can be cylindrical, rounded, rectangular, etc., with a diameter less than the diameter of cap opening 20.

The magnet can be housed within cap interior 25 using any known method, such as (but not limited to) the use of adhesive, epoxy, welding, molding, an internal housing, and the like. In some embodiments, more than one magnet can be accommodated within the interior of cap 15. Magnet 35 is arranged within cap 15 such that each magnet is magnetically attracted to a corresponding magnet positioned in a second alignment rod. The magnets of adjacent alignment rods are automatically attracted to each other, which assists in the neat and orderly storage of without any additional covers and sleeves.

Figure 7A:
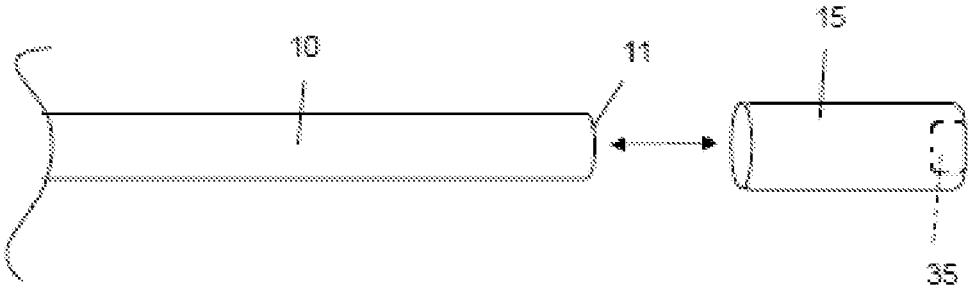
FIGS. 7*a* and 7*b* illustrate one embodiment of assembling a cap onto an alignment rod base in accordance with some embodiments of the presently disclosed subject matter.
Figure 7B:
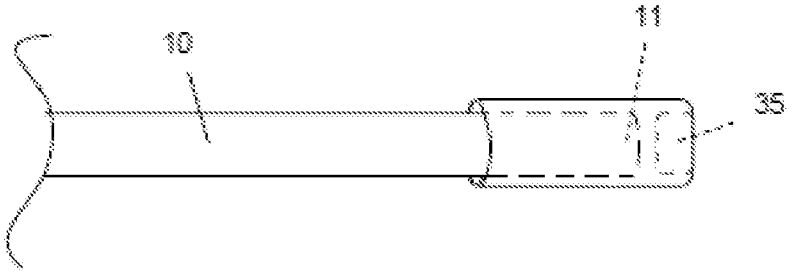

After the magnet is positioned within cap interior 25, the cap can be assembled on first end 11 of base 10, as shown in FIGS. 7*a* and 7*b*. As set forth above, the cap can be permanently or releasably attached to base 10. In some embodiments, first end 11 of the base can directly contact magnet 35. Alternatively, the base first end can be positioned adjacent to the magnet (e.g., with a distance of about 0.1, 0.2, 0.3, 0.4, 0.5, 0.6, 0.7, 0.8, 0.9, or 1 inch therefrom). It should be understood that the cap can be snugly attached to base 10, such that there is virtually no room therebetween. Alternatively, there can be room remaining between the cap and base.

Figure 7C:
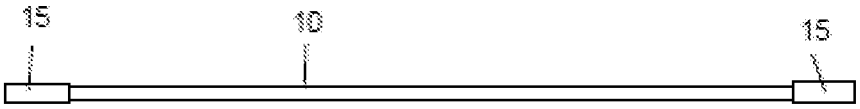
FIG. 7*c* is a side plan view of an alignment rod in accordance with some embodiments of the presently disclosed subject matter.
Figure 12:
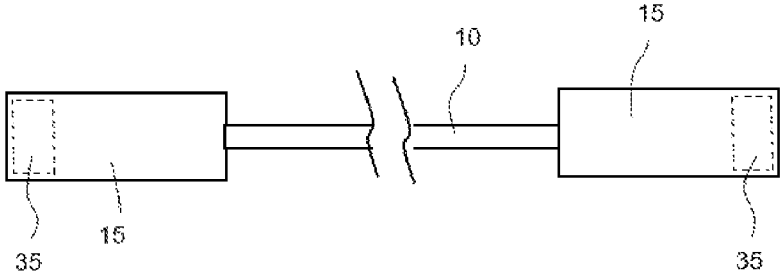
FIG. 12 is a fragmentary top plan view of an alignment rod comprising a first magnet (e.g., axial magnet) positioned at a first end and a second magnet (e.g., a diametric magnet) positioned at the second end in accordance with some embodiments of the presently disclosed subject matter.

In some embodiments, a second cap 16 comprising magnet 35 can additionally be positioned on the second end of the base, as shown in FIGS. 7*c* and FIG. 12. However, such a configuration is optional.

The base and/or cap can be constructed in any desired color, such as one or more of white, black, yellow, green, red, purple, blue, grey, silver, orange, etc. Similarly, the base and cap can include one or more patterns, such as (but not limited to) stripes, stars, dots, shapes, waves, and the like. The base and cap can further include words as desired by the user.

Figure 8A:
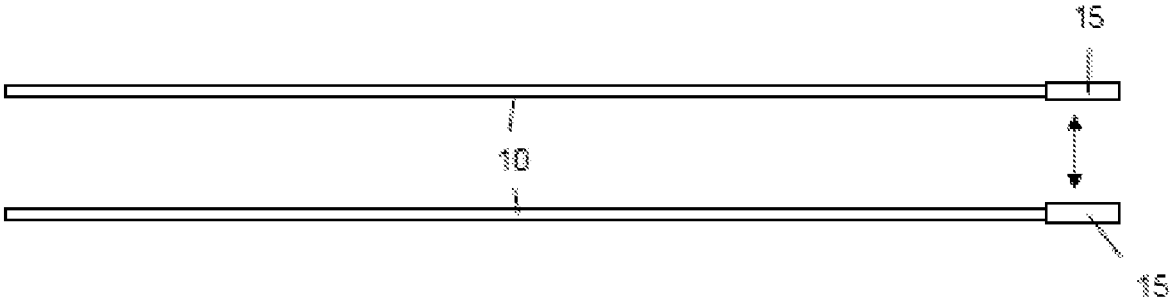
FIGS. 8*a* and 8*b* illustrate side plan views of alignment rods being paired in accordance with some embodiments of the presently disclosed subject matter.
Figure 8B:
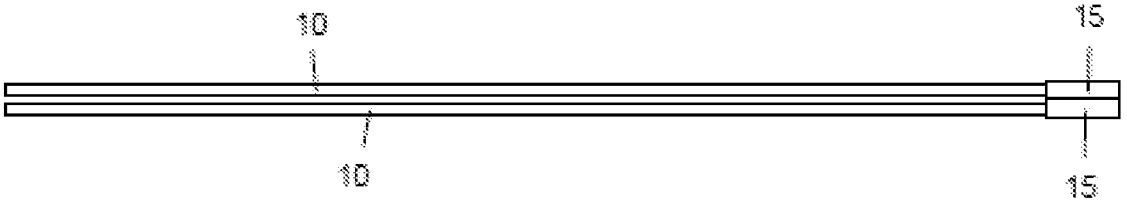
Figure 9:
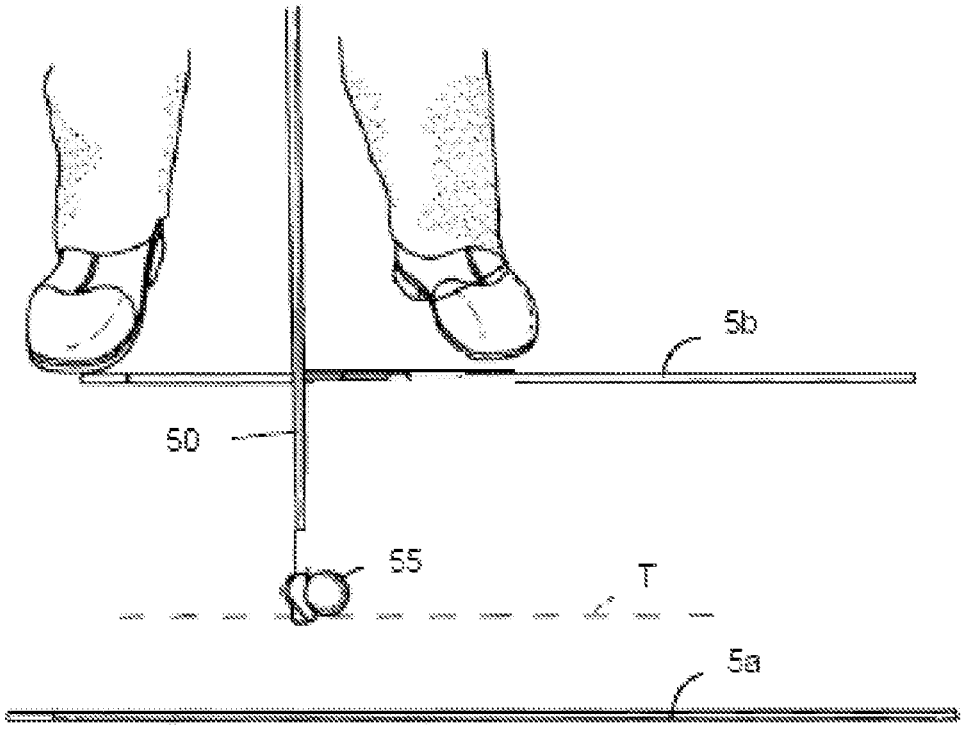
FIG. 9 is a perspective view of a pair of alignment rods in use in accordance with some embodiments of the presently disclosed subject matter.

In use, the magnet housed at cap end 30 allows at least two alignment rods to be coupled together due to magnetic attraction. As shown in FIGS. 8*a* and 8*b*, the magnets positioned within adjacent alignment rod caps attract each other. As is known, the magnetism of a magnet is concentrated at the poles. When the north pole of one magnet is brought close to the south pole of another magnet, they will attract each other. Alternatively, if the south pole of one magnet is positioned close to the north pole of another magnet, they will repel each other. Thus, the magnetic fields of adjacent magnets pull together (attract) at different poles (e.g., north pole and south poles attract, while two north poles or two south poles repel each other). In this way, two alignment rods 5 are maintained together, such as when carried inside a golf bag. As a result, the golfer can more easily access a pair of alignment rods. In addition, the mated alignment rods are better contained, and less likely to move around the golf bag, avoiding damage to golf clubs and other items.

When the user desires to use one or more alignment rods 5, he simply removes them from the golf bag as a pair (resulting from the magnetic attraction of magnets 35). The golfer applies light pressure to separate the alignment rods, placing them into proper position on the ground. The golfer can then use them as desired to improve his alignment to the ball. For example, the golfer can place the alignment rods on the ground parallel to each other. A first alignment rod 5*a* can be positioned along the target line T next to the golf ball, while a second alignment rod 5*b* is positioned along the golfer's toe line. The golfer can then get into his stance with proper alignment (such that golf club 50 is in the correct position to hit ball 55 towards a target). It should be appreciated that a golfer can use one or more alignment rods for any of a wide variety of training exercises. For example, in some embodiments, a rod can be vertically tucked into the elbow of the golfer with one end on the ground. In this way, proper body rotation can be controlled.

After the golfer has used the pair of alignment rods, he simply picks the rods up, and advances the caps towards each other until the magnetic attraction is great enough to couple the rods together. The golfer can then place the rods in a golf bag or to the side until needed again.

Figure 10A:
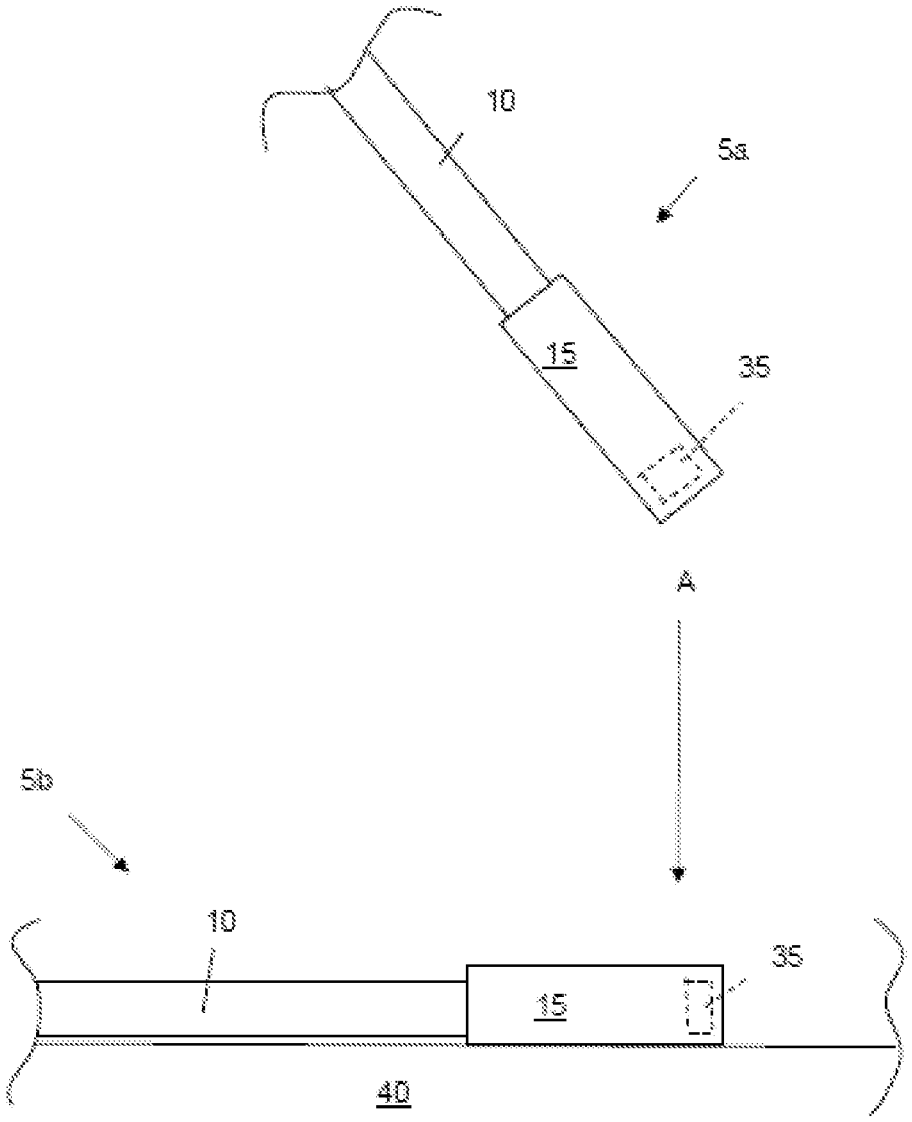
FIGS. 10*a*-10*c* illustrate a side plan view of one method of using an alignment rod in accordance with some embodiment of the presently disclosed subject matter.
Figure 10B:
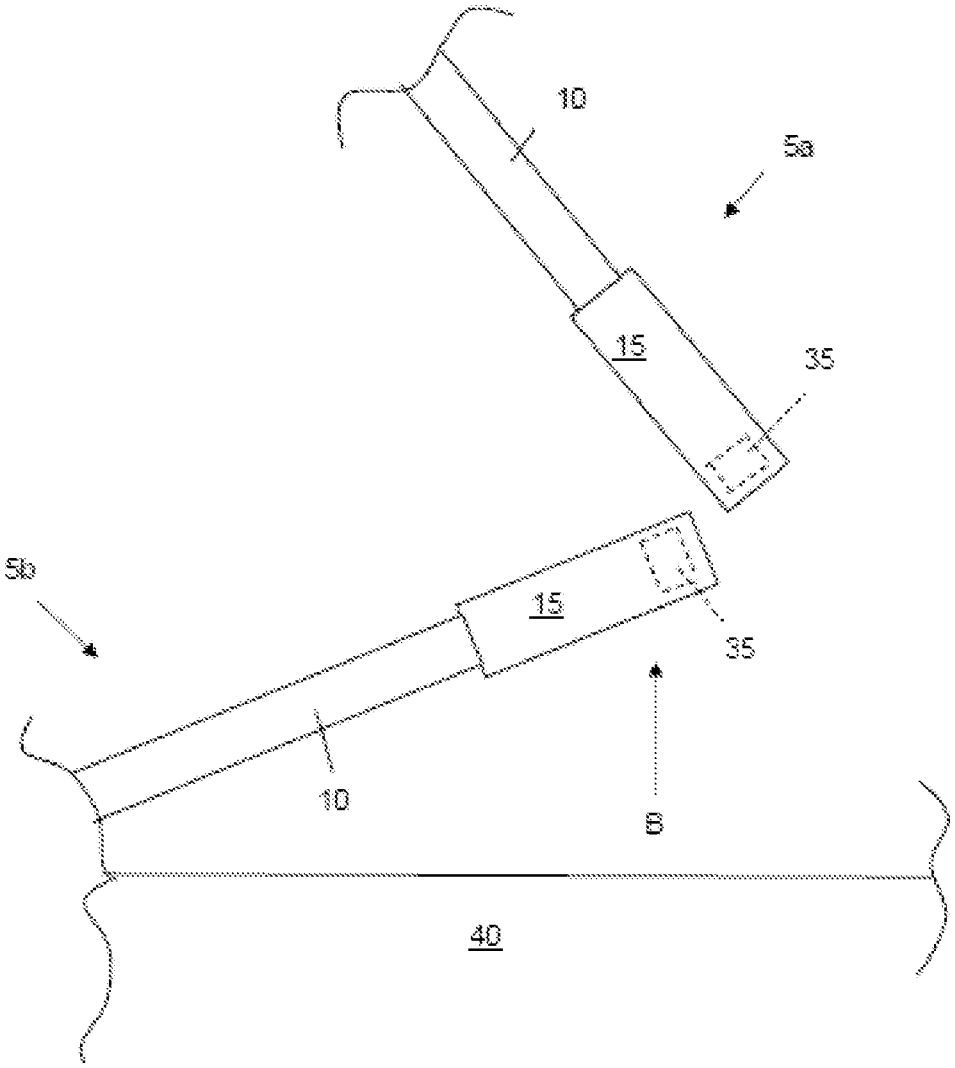
Figure 10C:
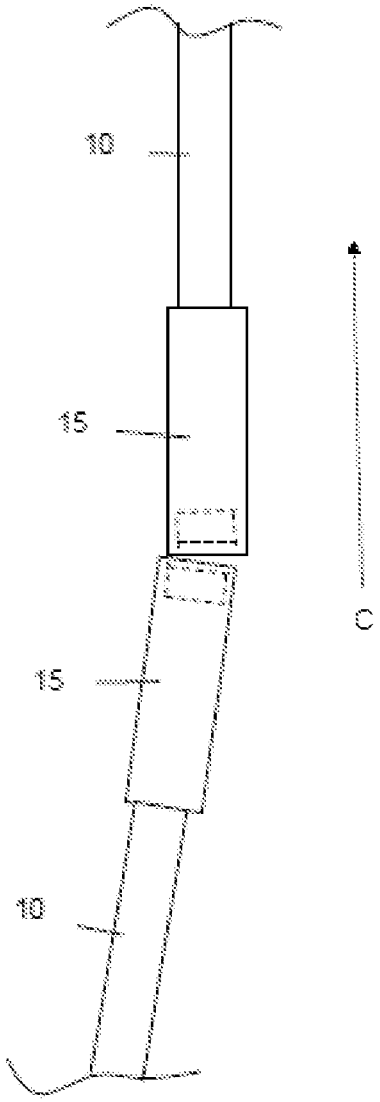
Figure 11A:
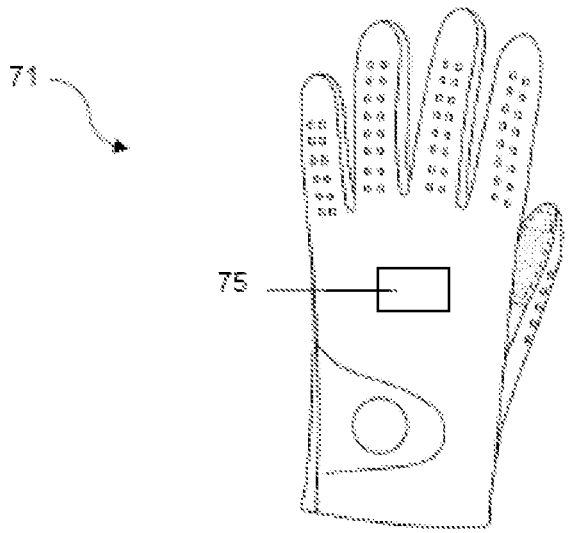
FIGS. 11*a*-11*d* are perspective views illustrating alternative embodiments of accessories that can be used in accordance with some embodiments of the presently disclosed subject matter.
Figure 11B:
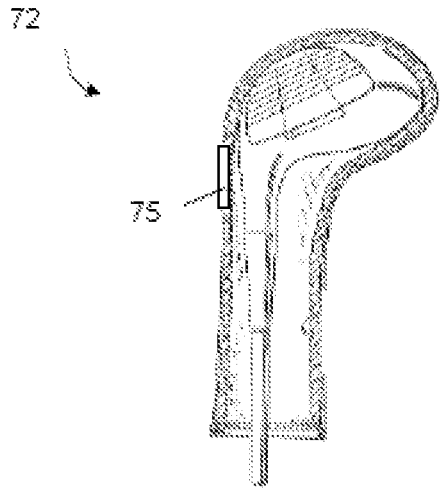
Figure 11C:
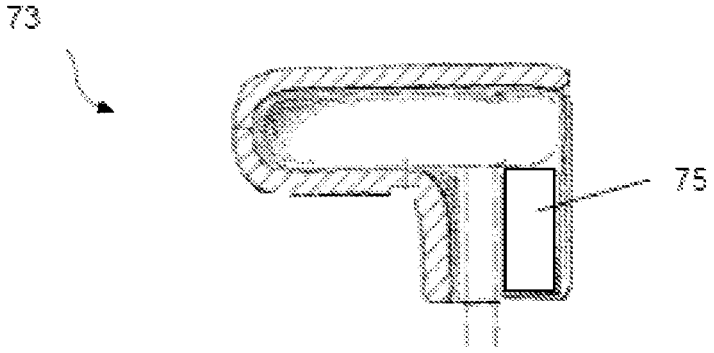
Figure 11D:
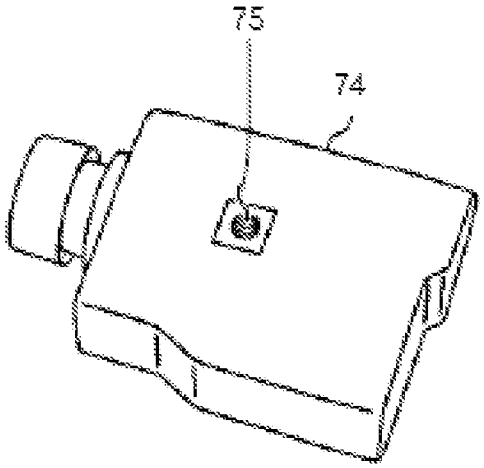

In some embodiments, the magnetic attraction of magnet 35 is great enough to allow the golfer to use a first alignment rod to pick up a second alignment rod from the ground. For example, the user can grasp first alignment rod 5*a* and position it such that cap end 15 nears the cap end of second alignment rod 5*b* lying on a support surface 40 (e.g., a putting green), as shown by Arrow A in FIG. 10*a*. Once the caps get close enough to allow magnets 35 to attract, the cap end of the second alignment rod raises to pair with the cap end of the first alignment rod, as shown by Arrow B in FIG. 10*b*. The golfer can then raise the first alignment rod, to pick both of the alignment rods up, as shown by Arrow C in FIG. 10*c*. In this way, he is prevented from having to bend down twice to pick up the rods.

In some embodiments, more than two alignment rods can be used at a time. Alternatively, a single alignment rod can be used for a desired exercise. In such cases, the user can apply slight pressure to separate one alignment rod 5 from a pair. Once separated, the user can position the alignment rod as desired. After use, the golfer can re-pair the alignment rods by joining the cap ends such that the magnets attract and keep the pair attached.

The presently disclosed subject matter can also include one or more optional accessories that can be removably coupled with an alignment rod. Specifically, accessory 70 can include magnet 75 that is attracted to alignment rod magnet 35. Magnet 75 can be attached to the accessory using any known method, such as (but not limited to) the use of sewing, adhesive, welding, and the like. Magnet 75 can include any material that is attracted to alignment rod magnet 35. Thus, magnet 75 can be constructed from iron, cobalt, nickel, copper, platinum, aluminum, and/or alloys thereof. The magnet can be positioned at any desired location on the accessory (e.g., front, rear, side, top, bottom, interior, and/or exterior).

Suitable accessories can include (but are not limited to) one or more golf gloves 71, golf club headcover 72, putter cover 73, and range finder 74, as shown in FIGS. 11*a*-11*d*. It should be appreciated that accessory 70 is not limited to the specific examples described and shown.

In use, a golfer can temporarily attach accessory 70 to an alignment stick via magnetic connection between magnets 75, 35. For example, a golfer can remove an accessory (e.g., golf club headcover 72) and temporarily attach it to the magnet of one or more alignment sticks 5 through magnetic attraction. The accessory is then conveniently accessible when needed (e.g., when the golfer desires to reapply the headcover to a golf club). At any time, the golfer can apply pressure to remove the accessory from the alignment rod, breaking the magnetic attraction between magnets 75, 35. The accessory can then be placed in the storage position (e.g., on a golf club, etc.).

Often the accessory is simply tossed to the ground or in the back of a golf cart, increasing the likelihood that the accessory is misplaced or damaged. The disclosed alignment rod can therefore prevent and or decrease the likelihood of damage to a wide variety of accessories 70.

The disclosed invention affords many improvements over the prior art. Specifically, the disclosed alignment rods allow optimized access of the alignment rods in a golf bag.

Advantageously, the disclosed alignment rods can be utilized in all capacities and functions of traditional golf alignment rods.

The disclosed alignment rods can be stored upright in a golf bag and automatically secured together through magnetic attraction of the rod caps.

The disclosed alignment rods are simple and effective training aids that can be used by a golfer in drills to practice virtually every aspect of the game of golf.

What is claimed is:

1. A golf alignment device, comprising:

a pair of coupled alignment rods, wherein each alignment rod is defined by:

an elongated base defined by opposing first and second ends separated by a length therebetween;

first and second caps, each comprising:

an interior;

an open end operably connected to the interior;

a closed end; and a magnet positioned within the interior;

wherein the first cap is positioned on the first end of the base, such that the first end is housed within the first cap interior;

wherein the second cap is positioned on the second end of the base, such that the second end is housed within the second cap interior;

wherein the pair of coupled alignment rods are releasably coupled together due to the magnetic attraction between the magnets of each alignment rod; and wherein the magnet positioned within the interior of the first cap, second cap, or both has a pull force of about 4-11 pounds.

2. The golf alignment device of claim 1, wherein the second end of the base of each alignment rod is tapered or pointed.

3. The golf alignment device of claim 1, wherein:

the base of each alignment rod is constructed from fiberglass, polymeric material, wood, metal, graphite, stone, or combinations thereof; and the cap is constructed from rubber, silicone, vinyl, fabric, polymeric material, leather, knit fibers, or combinations thereof.

4. The golf alignment device of claim 1, wherein the cap is permanently attached to the first end of the base.

5. The golf alignment device of claim 1, wherein the cap is releasably attached to the first end of the base.

6. The golf alignment device of claim 1, wherein the magnet positioned within the interior of the first cap, second cap, or both is a diametric magnet or an axial magnet.

7. The golf alignment device of claim 1, wherein the magnet positioned within the interior of the first cap, second cap, or both is constructed from one or more of iron, cobalt, nickel, copper, platinum, or alloys thereof.

8. The golf alignment device of claim 1, wherein the magnet positioned within the interior of the first cap, second cap, or both has a magnetization grade of N38-N52.

9. The golf alignment device of claim 1, wherein the first end of the base contacts the first magnet when the cap is positioned on the first end of the base.

10. The golf alignment device of claim 1, wherein the first end of the base is positioned adjacent to the first magnet when the cap is positioned on the first end of the base.

11. The golf alignment device of claim 1, wherein each alignment rod comprises a combination of axial and diametric magnets.

12. The golf alignment device of claim 1, wherein the base of each alignment rod has a different cross-sectional shape relative to the corresponding cross-sectional shape of the cap.

13. A golf alignment device, comprising:

a pair of coupled alignment rods, wherein each alignment rod is defined by:

an elongated base defined by opposing first and second ends separated by a length therebetween;

first and second caps, each comprising:

an interior;

an open end operably connected to the interior;

a closed end; and a magnet positioned within the interior;

wherein the first cap is positioned on the first end of the base, such that the first end is housed within the first cap interior;

wherein the second cap is positioned on the second end of the base, such that the second end is housed within the second cap interior;

wherein the pair of coupled alignment rods are releasably coupled together due to the magnetic attraction between the magnets of each alignment rod; and wherein each alignment rod has a length of about 30-60 inches, a diameter of about 0.1-1 inches, or both.

14. The golf alignment device of claim 13, wherein the magnet positioned within the interior of the first cap, second cap, or both is a diametric magnet or an axial magnet.

15. The golf alignment device of claim 13, wherein the magnet positioned within the interior of the first cap, second cap, or both has a magnetization grade of N38-N52.

16. A method of using a golf alignment device, the method comprising:

positioning the first alignment rod of the alignment device adjacent to the second alignment rod, such that magnetic forces couple the magnets of the first and second alignment rods together;

wherein the first and second alignment rods are uncoupled by separating the first and second alignment rods such that magnetic forces no longer couple the magnets of the first and second alignment rods together;

wherein the alignment device comprises:

a pair of coupled alignment rods, wherein each alignment rod is defined by:

an elongated base defined by opposing first and second ends separated by a length therebetween;

first and second caps, each cap comprising: an interior; an open end operably connected to the interior; a closed end; and a magnet positioned within the interior;

wherein the first cap is positioned on a first end of the base, such that the first end is housed within the first cap interior;

wherein the second cap is positioned on the second end of the base, such that the second end is housed within the second cap interior;

wherein the pair of coupled alignment rods are releasably coupled together due to magnetic attraction between the magnets of each alignment rod; and wherein the first alignment rod is configured to pick up the second alignment rod due to magnetic attraction, and vice versa.

17. The method of claim 16, wherein the second end of the base is tapered or pointed.

18. The method of claim 16, wherein the magnet positioned within the interior of the first cap, second cap, or both is a diametric magnet or an axial magnet.

19. The method of claim 16, wherein the magnet positioned within the interior of the first cap, second cap, or both has a magnetization grade of N38-N52.

20. The method of claim 16, wherein the magnet positioned within the interior of the first cap, second cap, or both has a pull force of about 4-11 pounds.

* * * * *